US006193235B1

(12) United States Patent
Vancura et al.

(10) Patent No.: US 6,193,235 B1
(45) Date of Patent: Feb. 27, 2001

(54) LIKE KIND CARD GAME

(75) Inventors: Olaf Vancura, Las Vegas, NV (US); Kenneth Allan Perrie, Groton, CT (US)

(73) Assignee: Mikohn Gaming Corporation

( * ) Notice: Subject to any disclaimer, the term of this patent is extended or adjusted under 35 U.S.C. 154(b) by 0 days.

(21) Appl. No.: 09/311,652

(22) Filed: May 13, 1999

Related U.S. Application Data

(60) Provisional application No. 60/085,315, filed on May 13, 1998.

(51) Int. Cl.[7] ..... A63F 1/00
(52) U.S. Cl. ..... 273/292
(58) Field of Search ..... 273/274, 292, 273/309; 463/12, 13

(56) References Cited

U.S. PATENT DOCUMENTS

| | | | | |
|---|---|---|---|---|
| 5,282,633 | * | 2/1994 | Boylan et al. | 273/292 X |
| 5,308,065 | | 5/1994 | Bridgeman et al. | 463/13 |
| 5,423,551 | * | 6/1995 | Stavinsky | 273/292 X |
| 5,431,408 | | 7/1995 | Adams | 273/306 |
| 5,605,333 | | 2/1997 | Field | 273/274 |
| 5,876,283 | * | 3/1999 | Parra et al. | 273/292 X |
| 5,944,314 | * | 8/1999 | Stavinsky | 273/292 |
| 6,003,870 | * | 12/1999 | Johnson | 273/292 X |
| 6,022,022 | * | 2/2000 | Smith | 273/292 |
| 6,036,190 | * | 3/2000 | Edmunds et al. | 273/292 |

FOREIGN PATENT DOCUMENTS

16269 * 10/1992 (WO) .

OTHER PUBLICATIONS

Un–Reel Slots Red–Five Gaming, LLC., Encinitas, CA 92024.

* cited by examiner

*Primary Examiner*—John A. Ricci
(74) *Attorney, Agent, or Firm*—Aaron Passman

(57) ABSTRACT

A casino card game using a deck of cards having a number of value cards and a number of subsets of cards. A first subset constitutes value cards which have value in the play of the game to provide winning combinations according to the game rules. A second subset are wild cards that assume the value of another value card in a players hand. A third subset of cards are player specific cards which when matching an identifier separately associated with the player, assumes special meaning in the players hand. A fourth subset termed worthless cards which have no value and occupies space in the hand. A fifth subset are losing cards which causes a hand to immediately lose. A sixth subset is termed contingent cards which causes the player to receive additional payoff when the player has a winning combination of value cards. A last subset are win cards which causes the hand to immediately win. During the play of the game, the deck of cards are shuffled and a player analyzes the hand for a winning combination of value cards.

26 Claims, 4 Drawing Sheets

LIKE KIND CARD GAME

This relates to Provisional application Ser. No. 60/085,315 filed May 13, 1998.

BACKGROUND OF THE INVENTION

1. Field of the Invention

The present invention relates to casino card games and, more particularly, to a variation of poker.

2. Background of the Invention

U.S. Pat. No. 4,807,885 is a card game wherein the cumulative value of the discards are continually added up to a chosen value "99" to be reached in the game. FIG. 4 of the '885 patent has special "pass" cards, "wild" cards, "reverse" cards, "no play joker" cards, and "automatic ninety-nine" cards. The "pass" card allows a player to pass to the next player; with a "reverse" card, a player shifts the direction of play; a "no play joker" card cannot be played thereby effectively reducing the playable cards in a player's hand, and "automatic ninety-nine" card moves the count of the discard stack to ninety-nine. The "wild" cards allow the player to adjust the cumulative value of the discard stack.

WO 92/16269 is a conventional gaming card game with added symbols for separate wagers. In one embodiment, two additional "no value" playing cards are added to the deck for an additional wager on if the two "no value" cards will be dealt consecutively during play of the underlying game.

U.S. Pat. No. 5,605,333 has a card game with a standard deck of cards wherein face cards and the ten card have a value of zero, and numbered cards retain their natural value except for fours and fives which are removed from the deck. To win one must come close to a target value in a suit.

U.S. Pat. No. 5,431,408 permits a player upon receiving a wild card to optionally reserve it for use in a subsequent hand. If the player elects this option, he/she receives a replacement card.

U.S. Pat. No. 5,308,065 has a standard card deck for poker, and each player receives a hand of five cards. A sixth card, not a part of the hand, is delivered to the player face down. The player has the right to improve the ranking of the dealt five-card hand by discarding up to five cards and replacing them. Thereafter, any cards in the hand with the same value as the sixth card are wild.

3. Statement of the Problem

Live card games continue to be popular in casinos around the world. One popular casino card game is poker and variations on poker have occurred over the years which have increased participation and excitement by players of these games at casinos. A need exists to provide variants on the game of poker.

A number of well-known board games, not generally suited for the casino environment, have also entertained the populace for a large number of years. A need exists to adapt such well-known board games to the casino environment. In general, such board games normally take a long period of time to play in the family or home setting. In the casino environment, such periods of time are too long and, in adopting a board game to the casino environment, a need exists to speed up the game while preserving the excitement and popularity of the board game.

In card games in general, all cards in the card games have value with respect to the play of the game. For example, in poker, each card in the deck has at least one value (i.e., rank or suit). When certain winning combinations of cards exist in a poker hand, the player wins. Conventional house banked poker games have straights and flushes as winning combinations which pay back winnings (usually multiples of the ante) to the player. While such combinations add variety to the game, a player must study the hand in order to play for these combinations. A need exists to simplify such analysis in order to provide a modified poker game which eliminates such straights and flushes winning combinations and the payoffs for them.

The use of a subset of cards in a casino card game called "wild cards" is conventionally known to exist. Wild cards also provide excitement to the game since a player, based upon the other value cards in the hand can select a value for a wild card appearing in his or her hand. A need exists for other "subsets" of cards in a card deck to make the casino card game more exciting to players.

Hence, an overall need exists to provide a new card game adapted for the casino environment which preferably adapts popular board games to the casino environment, which provides a poker-type card game with "straights and flushes" eliminated and which provides entirely new and different card subsets, all of which are designed to add excitement, speed, and rewards to players of such games at casinos.

4. Solution to the Problem

The present invention provides a solution to the aforesaid needs. The card game disclosed herein is a form of modified poker in which "straights and flushes" are eliminated. Furthermore, the card game provides a structure in which the play of a conventional board game may be adopted into. In the preferred embodiment, the conventional board game is MONOPOLY®.

The card game of the present invention incorporates several new subsets of cards in a deck which have application to casino card games in general and, in specific, to the adaption of a board game in a modified form as discussed herein. The first subset of cards is termed "worthless" in that they constitute a predetermined number of cards that have no value in a game. The second subset of cards is termed "loser" in that the receipt of such a card causes the player to immediately lose the hand. A third subset of cards is termed "player specific" cards. When the player receives the special player card and the card corresponds to a separate identifier of the player, the card assumes special meaning—e.g., a wild card. If it does not correspond, it assumes a different meaning—e.g., a "worthless" card in the play of that hand. A fourth subset of cards is termed "contingent" cards. When the player receives the contingent card and the player has a winning hand (for example, a winning like-kind group of cards) the presence of a contingent card in his or her hand adds additional payoff value. If the player does not have a winning combination in the hand, the card is worthless. Hence, the contingent card has a value contingent on what other cards are present in the hand. A final subset of cards is termed "win" cards. When the player receives the win card, the player automatically wins.

SUMMARY OF THE INVENTION

A casino card game using a deck of cards. In the deck of cards are a number of different subsets of cards. The majority of cards in the deck of cards are "value" cards which have value in the play of the game to provide winning combinations according to the rules of the game. In the preferred embodiment, the winning combinations are based upon value cards of like-kind. A first subset of cards in the deck of cards are wild cards that assume the value of a value card in a player's hand. A second subset of cards in the deck of cards are termed "player specific" cards. When a player receives a player specific card in the hand which matches an identifier separately associated with the player, the player specific card assumes a special meaning such as the value of a value card in the player's hand. However, when the player specific card does not match the identifier separately associated with the player, the player specific card does not assume the special meaning. In the preferred embodiment, a symbol is used to determine the special meaning of the player specific card. However, any intrinsic, extrinsic or randomly assigned identifier could be used to provide the association. A third subset of cards in the deck of cards are termed "worthless" cards. When the player receives a worthless card in the hand, the worthless card assumes no value and occupies space in the hand. A fourth set of cards in the deck of cards are termed "losing" cards and when a player receives a losing card in the hand, the hand immediately loses. A fifth subset of cards is termed "contingent" cards. A contingent card in a players hand causes the player to receive additional payoff when the player has a winning combination of value cards. If the player does not have a winning combination of value cards, the contingent card is a worthless card and occupies space in the hand. A last subset of cards is termed "win" cards and when a player receives such a card, the player wins. During the play of the game, the deck of cards are shuffled and a player analyzes the hand for a winning combination in the value cards which in the preferred embodiment are cards of like-kind. A wild card may be used to obtain a winning combination. When the player has a winning combination, a payoff is received based upon a payoff chart. If a contingent card is in the player's hand in addition to a winning combination, the player receives additional payoff such as multiples of the payoff based upon the winning combination. The presence of a losing card in a player's hand even with a winning combination of value cards causes the player to lose. The use of wild, player specific, worthless, losing, contingent, and win cards in the deck or decks of cards of the present invention are optional and any combination of these subsets including one subset, some of the subsets, or all of the subsets may be utilized.

A casino card game may include a deck of cards so a hand of cards can be randomly dealt from the deck to at least one player. The hand might have at least one card and the deck of cards could have:

(a) a plurality of value cards in the deck of cards, and (b) a subset of cards in the deck of cards containing player specific cards; when the player receives a player specific card in the hand which matches an identifier separately associated with the player, the player specific card assumes a special meaning in the player's hand; when the identifier does not match the identifier separately associated with the player, the player specific card does not assume the special meaning;

the hand having value when at least one winning combination of value cards exists in the hand.

The plurality of value cards may comprise groups of like-kind cards and the winning combination is one of the groups of like-kind cards. The player specific card that does not assume the special meaning might assume a different special meaning. Each group of like-kind cards preferably has a different color. The special meaning might preferably comprise a wild card. The special meaning could comprise a can't lose hand. The identifier may comprise an extrinsic identifier wherein the extrinsic identifier can comprise a symbol near the player. The identifier could comprise an intrinsic identifier. The identifier might comprise a randomly selected identifier. The hand wins when the at least one winning combination is found in a pay table. The hand wins when the at least one winning combination is greater than the dealer's hand. The hand wins when the at least one winning combination is greater than a player's hand. A display may show the cards dealt. A pay table may be included for use in a like-kind game where a player has the option to draw and replace cards to complete a like-kind hand.

The deck of cards might include a plurality of value cards and a subset of cards containing worthless cards so when the player receives a worthless card in the player's hand, the worthless card assuming no value in the hand. The hand having value when at least one winning combination of like kind value cards exists in the hand. A display can show the cards dealt. A pay table might be included for use in a like-kind game where a player has the option to draw and replace cards to complete a like-kind hand.

The deck of cards could have a plurality of value cards and a subset of cards containing losing cards so that when the player receives a losing card in the hand, the hand loses. The hand may have value when at least one winning combination of value cards exists in the hand.

The deck of cards might have a plurality of value cards in the deck of cards and a subset of cards in the deck of cards containing contingent cards. The contingent card can have a significance contingent upon what other cards are present in the player's hand. The hand can have value when at least one winning combination of value cards exists in the hand. The contingent card yields additional payoff value when used with a winning combination of the value cards.

The deck of cards might include a plurality of value cards, a subset of cards containing player specific cards so when the player receives a player specific card in the hand which matches a symbol separately associated with the player, the player specific card assumes a special meaning in the player's hand; when the symbol does not match the symbol separately associated with the player, the player specific card does not assume the special meaning, another subset of cards containing worthless cards; when the player receives a worthless card in the player's hand, the worthless card assuming no value in the hand, another subset of cards containing contingent cards, the contingent card having a significance contingent upon what other cards are present in the player's hand. The hand having at least one winning combination when a number of received cards of the same value exist in the hand.

DETAILED DESCRIPTION OF THE INVENTION

1. Overview

Figure 1:
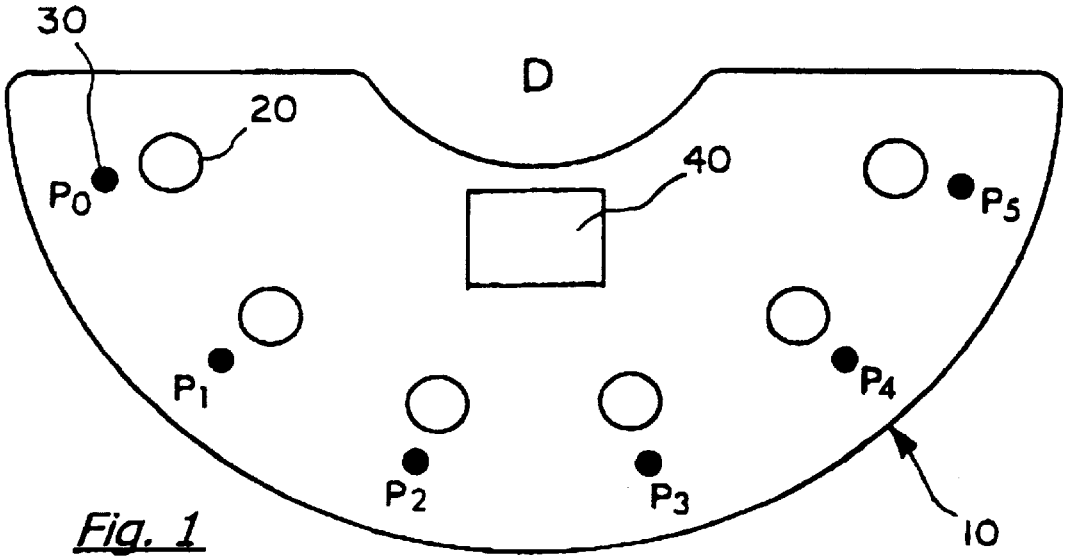
FIG. 1 is a top planar view of a gaming table of the present invention.

The present invention as shown in FIG. 1 is preferably played on a game table 10 having a number of player positions such as six player positions shown P0 through P5 and a dealer position, D. It is to be expressly understood that any suitable number of player positions could be utilized and that the teachings of the present invention are not to be limited to six. In addition, while the preferred embodiment of the present invention is ideally suited for live card game play at a gaming table 10 in a casino, it is to be expressly understood that the game disclosed herein, and modifications thereto, could be incorporated into gaming machines such as has occurred for video poker, etc. Furthermore, it is to be expressly understood that the game of the present invention could also be incorporated into an internet or intranet environment wherein the positions P0 through P5 of FIG. 1 could be individual terminals located in the casino, in hotel or motel rooms of the casino, or remote from the casino such as in an individual's home and those territorial jurisdictions where internet or intranet gambling is allowed.

At each player position is a bet area 20 at which a player places a wager. The wager could be any conventional medium or type of wagering including but not limited to: casino chips, casino chips with passive transponders, currency, credit cards, debit cards,. player cards, smart cards. Furthermore, suitable conventional devices could be located at or near area 20 to read the value of the wager from the medium.

Figure 2:
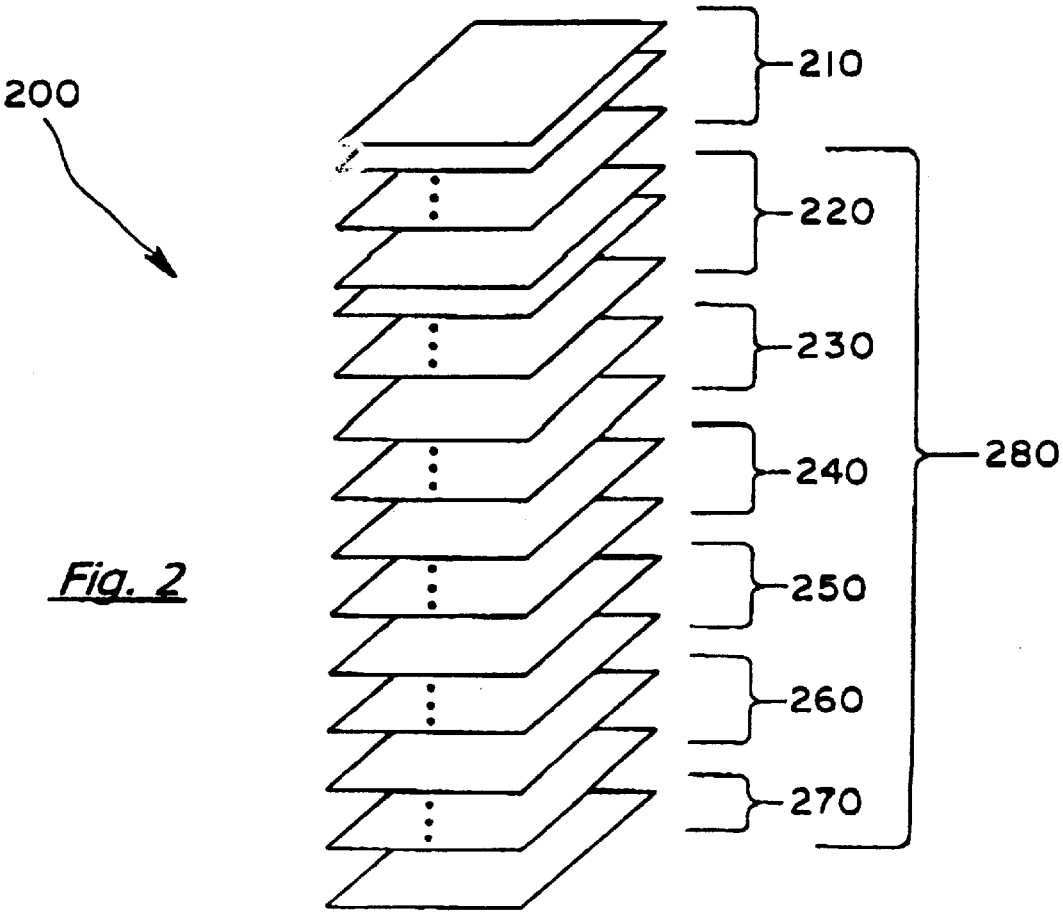
FIG. 2 sets forth the components of the deck of cards of the present invention.

The card game of the present invention utilizes a deck 200 of cards as shown in FIG. 2. In the preferred embodiment, the deck 200 consists of any number of cards including the conventional 52 cards. The teachings of the present invention are not to be limited to the number of cards in the deck 200. The deck 200 breaks down as follows:

TABLE I

| Category of Card | Reference Number in FIG. 2 |
|---|---|
| Value | 210 |
| Wild | 220 |
| Player Specific | 230 |
| Worthless | 240 |
| Lose | 250 |
| Contingent | 260 |
| Win | 270 |

The wild cards 220, the player specific cards 230, the worthless cards 240, the lose cards 250, the contingent cards 260, and the win cards 270 constitute subsets 280 to the deck 200. The value cards 210 are based upon the play rules of the game which may be any suitable poker-type game under the teachings of the present invention or any suitable card game adapted to play a live card game version of a board game. The actual number of the subset cards 280 in each category is based upon design preferences. Whether or not each subset is to be utilized in the card game is also a matter of design preference. For instance, a card game of the present invention could include wild 220, player specific 230, and worthless 240 cards. Or, another card game of the present invention could incorporate only player specific 230, worthless 240, and contingent 260 cards. Any combination of the subsets 270 could be utilized under the teachings of the present invention.

Furthermore, card games of the present invention are preferably based upon a single deck of cards as discussed herein. However, the teachings of the present invention are not limited to use of only a single deck of cards. Multiple decks of cards could also be utilized. In such multiple deck card games of the present invention, the subsets 270 can be distributed in a different fashion. For example, the contingent 260 card can be a single card covering several decks and when the presence of the contingent card in conjunction with a winning combination in a player's hand causes the player to win a large multiple.

The "value" cards 210 are adapted for the play of the game which could be based upon the conventional card rank in a poker card game or which could be specially created cards. The specially created cards could be based upon groups, G, of, for example, colors, symbols, alphanumerics, graphics, or any combination of the aforesaid. Each group would have specific elements E corresponding to the number of cards in the group. For example, in a conventional deck of cards used to play poker, the group could be ranked such as: seven, seven, seven, seven. Or, in the case of a specially designed card, a group could be the design of a happy face graphic and the group could be composed of three happy faces. When a player receives a winning combination comprising all elements E in a specific group G, the player wins. That is, when the player receives a "like-kind" for a group, a winning combination is produced.

The "wild" cards 220 are used by a player to assume the value of a value card. When any player in the game receives a wild card 220 in his or her hand, the player has the full discretion as to which color card 210 in their hand the wild card can become. A wild card, in the preferred embodiment, 220 does not assume the characteristics of any other subset card 270. Hence, the player, by choice, can select a wild card to be the value of a value card in order to achieve a winning combination according to the rules of the game.

Figure 3:
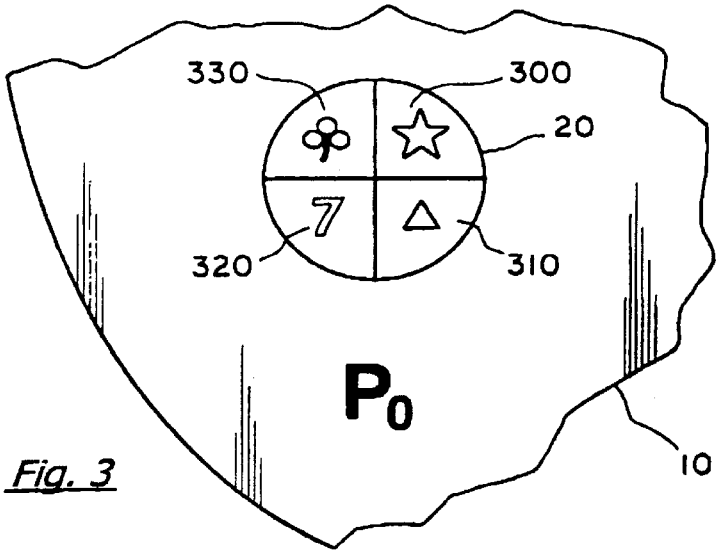
FIG. 3 sets forth one embodiment of the wager area of the present invention.

A "player specific" card 230 requires the player to have a corresponding separate identifier in which case the player specific card 230 assumes a special meaning such as becoming a wild card. However, the special meaning could be any one of the other subsets 270 discussed above or any other meaning such as, but not limited to: awarding a comp such as a free meal, immediate cash payment, etc. The separate identifier can be intrinsic, extrinsic, or randomly assigned. Examples of intrinsic identifiers are personal to the play and may correspond to the gender, age, what state they are from, etc. In other words, if the intrinsic identifier is personal to the player, but can be separately proven. An extrinsic identifier could be, for example, a symbol (as will be explained subsequently) embossed on or present at the player position so that the symbol extrinsically identifies the player. Or, the identifier can be randomly assigned. For example, the player may sit at a player position and activate a random device such as mechanical dice, spinning a wheel, etc. and obtain a symbol randomly assigned to it. An example of an extrinsic symbol is shown in FIG. 1. At each player position in FIG. 1 a different symbol 30 could be provided. Assume the symbol is a four-leaf clover for player position $P_0$, a star for position $P_1$, a seven for position $P_3$, a triangle for position $P_4$, etc. Hence, when the player sitting at position $P_0$ receives a player specific card 230 having a four-leaf clover, this card obtains a special meaning such as a wild card so that the player at position $P_0$ can use it exactly like a "wild card". However, if the player at position $P_0$ receives a symbol for a star corresponding to player position $P_1$, then the player specific card 230 is worthless (i.e., the clover does not match star). Hence, it is clear, under the teachings of the present invention, this "subset" of player specific cards actually takes on a special meaning depending upon a specific player match such as through use of the separate symbol 30. It is to be expressly understood that the player specific match can occur through a number of different approaches and that teachings of the present invention are not to be limited to the use of a symbol 30 on the game table 10 as shown in FIG. 1. For example, and as shown in FIG. 3, the wager area 20 can comprise separate betting areas 300, 310, 320, and 330. Player $P_0$ can choose any one of the four areas to place a wager. The player $P_0$ may place a wager on the four-leaf clover betting area 330 and when the player receives the player specific card 230 containing the four-leaf symbol, it assumes a special meaning such as becoming a wild card. Should the player receive a star, a triangle, or a seven, the player specific card 230 becomes worthless. It may be that in certain variations of the card game of the present invention, a player such as $P_0$ may place more than one wager. For example, a player may place a wager in all four areas 300, 310, 320 and 330 thereby activating all four symbols so that when one player receives the player specific card 230, corresponding to a wagered symbol it becomes wild in their hand.

A "worthless" subset card 240 has no value and the player can make no use of the card in the hand. Essentially, worthless cards 240 occupy space in a player's hand and provide no value.

A "lose" subset card 250 when received by a player simply causes the player to be an outright loser. The player is immediately eliminated from the game and loses any wager in the bet area 20 on the table 10.

A "contingent" subset card 260 when received by a player in a player's hand causes the player to receive additional payouts when the player also has a winning combination of value cards. If the player does not have a winning combination of value cards in the hand, the contingent card has no value. Thus, it's use depends on what the player has in his/her hand. For example, obviously, a "contingent" card could cause a winning player's hand to lose, and a losing player's hand to win.

A "win" subset card 270 when received by a player in a player's hand causes the player to win whether or not the player has any winning combination of value cards. This win card 270 could also be used to win a progressive jackpot. In which case, one win card could be provided in a multi-deck arrangement so that it infrequently occurs.

Each of the above-described subsets when used in conjunction with the value cards in a deck or a multi-deck arrangement adds substantial excitement to the card game of the present invention. Furthermore, one, some, or all of the subsets described above could be selectively used to design different like-kind card games of the present invention.

2. Adaption to Board Game

The teachings of the present invention can be adapted to play any of a number of popular board games. One of the most popular board games is MONOPOLY® which is played on a board. MONOPOLY® is a trademark of the Hasbro, Inc. Dice are conventionally utilized to effectuate play of pieces around the periphery of the board. The goal of the game is to acquire property and "community chest" cards and "chance" cards are provided in the play of the game.

The game table 10 and the deck 200 of the present invention are utilized to adapt board games into a form of poker for play in a casino. The resulting card game, under the teachings of the present invention, does not use the layout of a game board, does not use individual playing pieces and does not have other attributes specific to a board game. The following is an example:

TABLE II

| Color of Value Card 210 | Color Element Properties |
|---|---|
| Cyan | Connecticut, Vermont, Oriental |
| Purple | Baltic, Mediterranean |
| Violet | Virginia, States, St. Charles |
| Orange | New York, Tennessee, St. James |
| Red | Illinois, Indiana, Kentucky |
| Yellow | Marvin Gardens, Ventor, Atlantic |
| Green | Pennsylvania, North Carolina, Pacific |
| Blue | Boardwalk, Park Place |
| White | Short Line, Reading, Pennsylvania, B & O Railroads |
| White | Water Works, Electric Company |

In a first embodiment, the like-kind of card game, under the based upon the following deck 200 of cards:

TABLE III

| Type of Card | Number of Cards | Name |
|---|---|---|
| Value | 22 | Color-coded property cards |
| Value | 4 | Railroad cards |
| | 2 | Utility cards |
| Wild | 3 | Community Chest cards - wild cards |
| | 3 | Chance cards - wild cards |
| Worthless | 3 | Luxury Tax cards - "worthless" cards |
| | 3 | Income Tax cards - "worthless" cards |
| | 3 | Go To Jail cards - "worthless" cards |
| | 3 | In Jail cards - "worthless" cards |

There are a total of 46 cards in deck 200, and the card game table 10 will utilize a standard number (i.e., 6 or 7) of betting areas. COMMUNITY CHEST and CHANCE cards act as wild cards 220 for any colored property. The "worthless" cards 240 have no value toward hand ranking. The object of the game is to obtain "like kinds" of the value cards such as a monopoly, 2 RR, etc., for example all three green property cards or 1 green +1 COMMUNITY CHEST +1 CHANCE, etc. In this embodiment, no dealer hand is used; rather players compete by comparing their hands to paytable 40. In other embodiments, the dealer would also receive a hand and the players' hands would then be compared to the dealer's hand to determine winners and losers. Another embodiment would have players comparing hands to each other.

In the preferred embodiment, a player makes a 2-unit Ante wager in bet area 20, which entitles the player the right to "buy" 4 properties (cards) from the house. The dealer D deals four cards to the player. The player has the option to "mortgage" his or her hand by folding, thus forfeiting 50% of the Ante (losing 1 unit). Otherwise, the player stays in the hand, thus risking the original 2 units wagered while receiving one more card from the dealer D. Thereafter, the hand of 5 cards is compared to the pay table 40 (shown in Table IV) to pay the wagers on the winning combinations.

TABLE IV

| Winning Combination | Pays |
|---|---|
| 2 color groups (no Wild) | 100 to 1 |
| 2 color groups (w/Wild) | 3 to 1 |
| 1 color group (no Wild) | 2 to 1 |
| 1 color group (w/Wild) | 1 to 1 |
| 4 railroads | 100 to 1 |
| 3 railroads | 3 to 1 |
| 2 railraods | 2 to 1 |
| 2 utilities | 1 to 1 |

The above payoffs are examples only and are based on the total (2 unit) wager. With optimal strategy on the part of the player, the house advantage is 2.2% of the original 2-unit wager (0.044 units). The payoff table set forth above represents one of many possible payoff variations for this specific embodiment. It is to be expressly understood that any suitable payoff table could be utilized under the teachings of the present invention and that such payoff tables depend on the nature and design of the "winning combinations."

In a second, most preferred embodiment, the like-kind of card game, under the teachings herein, is based upon the following deck of cards:

TABLE IIIa

| Type of Card | Number of Cards | Name |
|---|---|---|
| Value | 22 | Color-coded property cards |
| Value | 4 | Railroad cards |
| | 2 | Utility cards |
| Wild | 2 | Community Chest cards - color-wild cards |
| | 3 | Chance cards - color-wild cards |
| Worthless | 5 | Tax cards |
| Player Specific | 7 | Token cards |
| Contin-Gent | 1 | Hotel card |
| | 4 | House cards |

There are a total of 50 cards in the deck. As before, COMMUNITY CHEST and CHANCE cards act as wild cards 220 for any colored property, and "worthless" cards 240 have no value toward hand ranking. The "player specific" cards correspond to tokens depicted on the layout, and act in a "Can't Lose" capacity should a player receive a Token card which matches the token depicted at his/her betting position. Should the player receive a Token card which does not match the token depicted as his/her betting position, the card instead functions in a "worthless" capacity. The "contingent" cards, if combined with a complete color-group add to the payoff in the following manner: House—an extra 1× the standard Go color-group pay (defined below), Hotel—an extra 3× the standard Go color-group pay (defined below). The "contingent" cards, if not combined with a complete color-group, instead function in a "worthless" capacity.

In the preferred embodiment, a player makes a 1-unit Ante wager in bet area 20, which entitles the player the right to "buy" 4 properties (cards) from the house. The dealer D deals four cards to the player. The player has the option to Fold his or her hand, thus forfeiting the Ante (losing 1 unit). Otherwise, the player may "Go" by wagering an additional amount equal to the Ante, hence risking 2 units while receiving the benefit of one more card in the form of a common 5th card shared by all players. Thereafter, the hand of 5 cards is compared to the paytable shown in Table IVa. Any winning hand (of 2 utilities, 2 or more railroads, 1 or more color groups) is paid 1 to 1 on the Ante, and according to the following paytable for the Go bonus.

TABLE IVa

| Winning Combination | Go Pays |
|---|---|
| 2 color groups (no wild) | 125 to 1 |
| 2 color groups (w/Wild) | 12 to 1 |
| 1 color group (no Wild) | 6 to 1 |
| 1 color group (w/Wild) | 1 to 1 |

TABLE IVa-continued

| Winning Combination | Go Pays |
|---|---|
| 4 railraods | 100 to 1 |
| 3 railroads | 20 to 1 |
| 2 railraods | 2 to 1 |
| 2 utilities | 3 to 1 |

With optimal strategy on the part of the player, the house advantage is 4.3% of the original 1-unit wager. The payoff table set forth above represents one of many possible payoff variations for this specific embodiment. It is to be expressly understood that any suitable payoff table could be utilized under the teachings of the present invention and that such payoff tables depend on the nature and design of the "winning combinations." Furthermore, this game could be played like draw poker, wherein the player has the option to draw and replace cards to complete a like-kind hand, which may be compared to a pay table.

3. Variations

Figure 4:
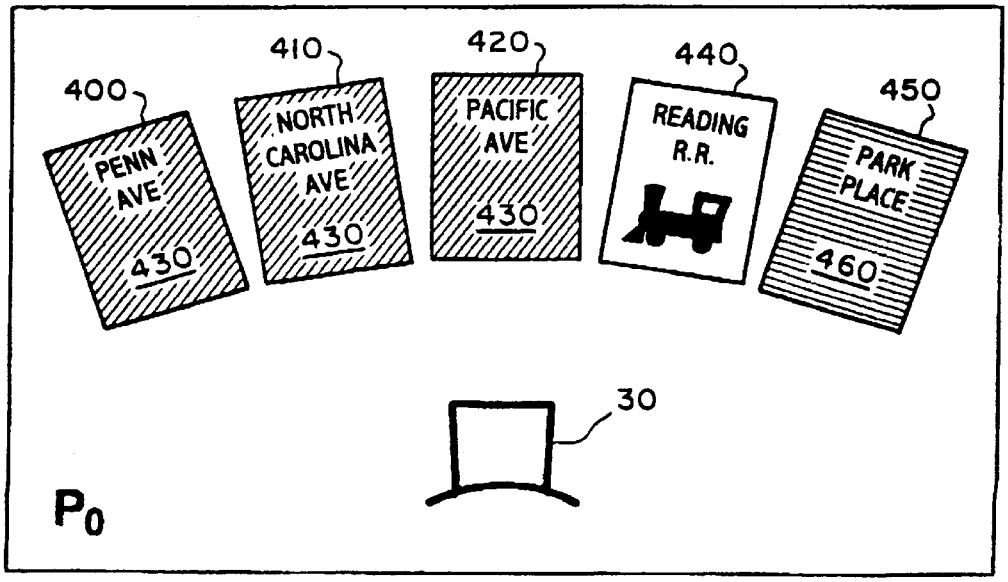
FIG. 4 is an illustration showing one hand of the card game of the present invention.

In FIGS. 4 through 7 are examples of game-end hands in the MONOPOLY® card game in the first embodiment discussed above held by a player $P_0$, received from the dealer D. In the preferred embodiment, the dealer D does not receive any cards. Rather, the dealer D deals the cards out and player $P_0$, as shown in FIG. 4, receives the five cards as shown. The player at position $P_0$ receives Pennsylvania Avenue 400, North Carolina Avenue 410, Pacific Avenue 420, Reading Railroad 440, and Park Place 450. According to the rules of MONOPOLY®, Pennsylvania Avenue, North Carolina Avenue, and Pacific Avenue are cards of the same color (i.e., like kind value). As shown in FIG. 4, cards 400, 410, and 420 are all of the same color 430. The other two cards 440 and 450 are cards of value, but cards 400, 410, and 420 represent a winning combination (i.e., one monopoly—no wild). The player $P_0$ looks at pay table 40 in FIG. 1 on the gaming table and ascertains, based upon Table IV, that the award for the winning combination is 2:1 on each of the two units (i.e., four units).

Figure 5:
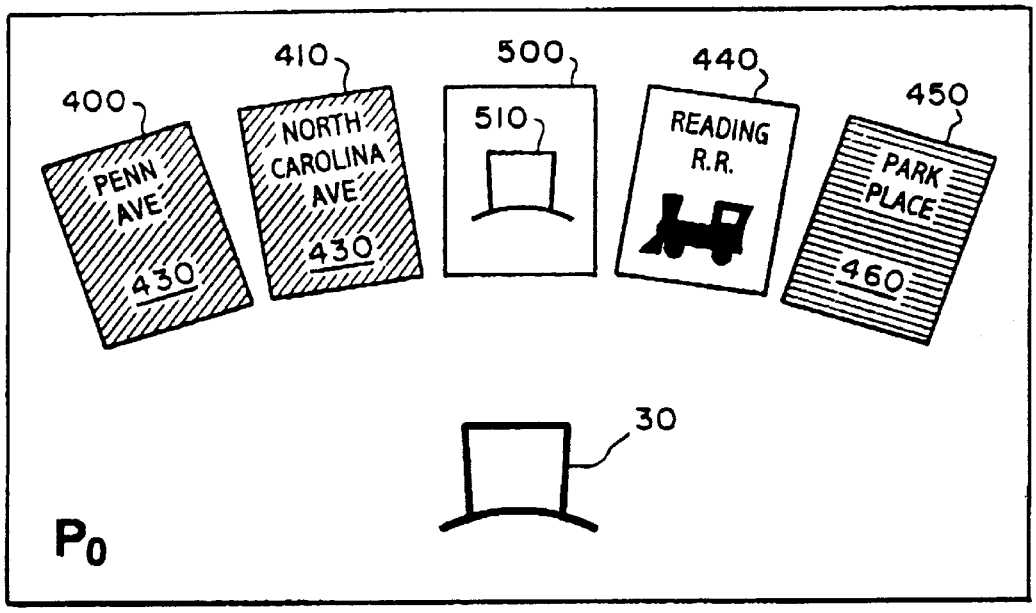
FIG. 5 represents a second hand of the card game of the present invention.

In FIG. 5, the player $P_0$ receives a special player card 500 having a symbol 510. The remaining cards are the same as in FIG. 4. The symbol 510 is for a top hat and the player sitting at position $P_0$ has the top hat symbol 30 embossed on the table top. Hence, player $P_0$ treats the special player card 500 as a wild card and has a choice between two separate winning combinations of: Pennsylvania Avenue, North Carolina Avenue, Pacific Avenue and treating card 500 as Pacific Avenue. In this embodiment, wild cards only substitute for color property cards. The second winning combination is treating card 500 as Board Walk and combining it with Park Place 450 to create a winning combination. In this case, it doesn't matter how the player would treat card 500 since the winning combination in Table IV is one monopoly (with wild) or a payoff of 1:1.

Figure 6:
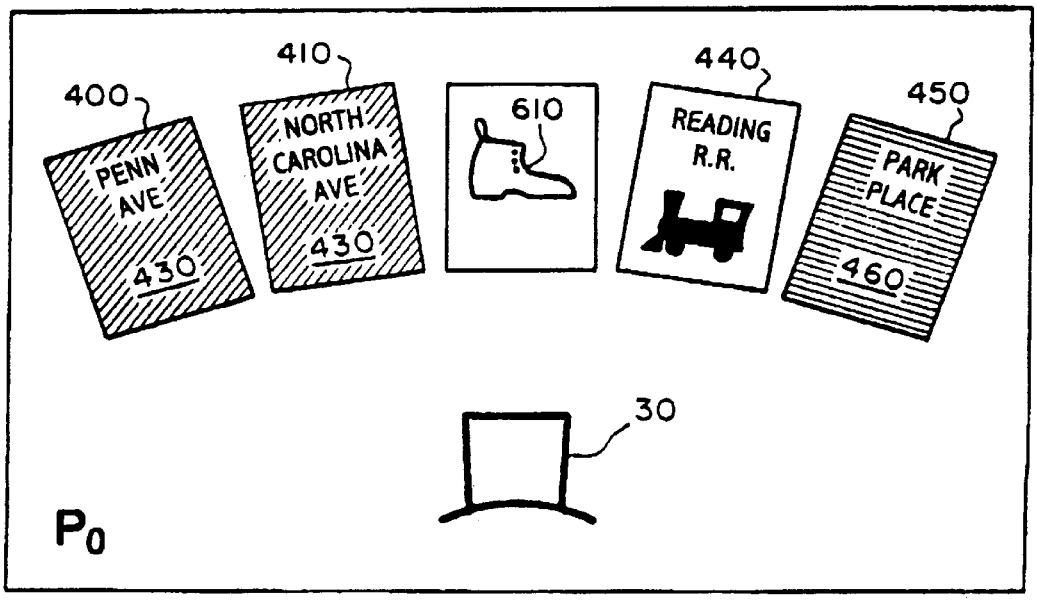
FIG. 6 represents a third hand of the card game of the present invention.

In FIG. 6, player $P_0$ receives card 600 which is also a special player card showing the symbol of a shoe 610. This symbol 610 does not match the position symbol 30 of a top hat and, therefore, card 600 is treated as a worthless card and player at position $P_0$ has no winning combinations and loses.

Figure 7:
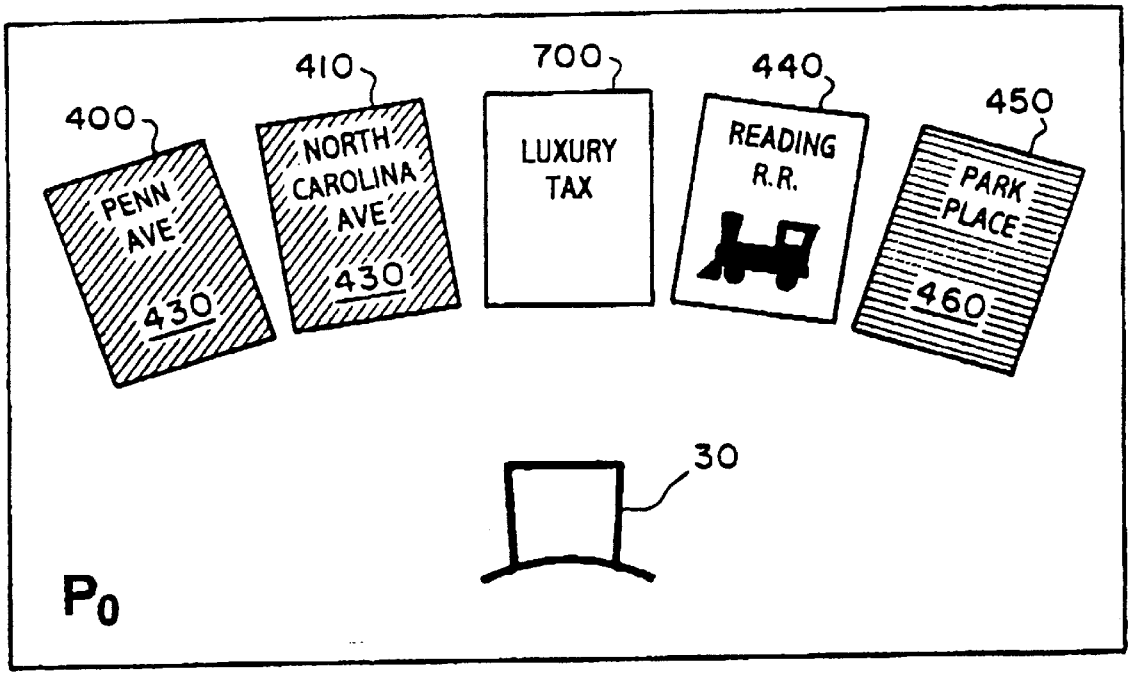
FIG. 7 represents a fourth hand of the card game of the present invention.

In FIG. 7, player $P_0$ receives a luxury tax card 700 which in the category above is a worthless card and, therefore, player $P_0$ with this hand does not have any winning combination and loses.

Figure 8:
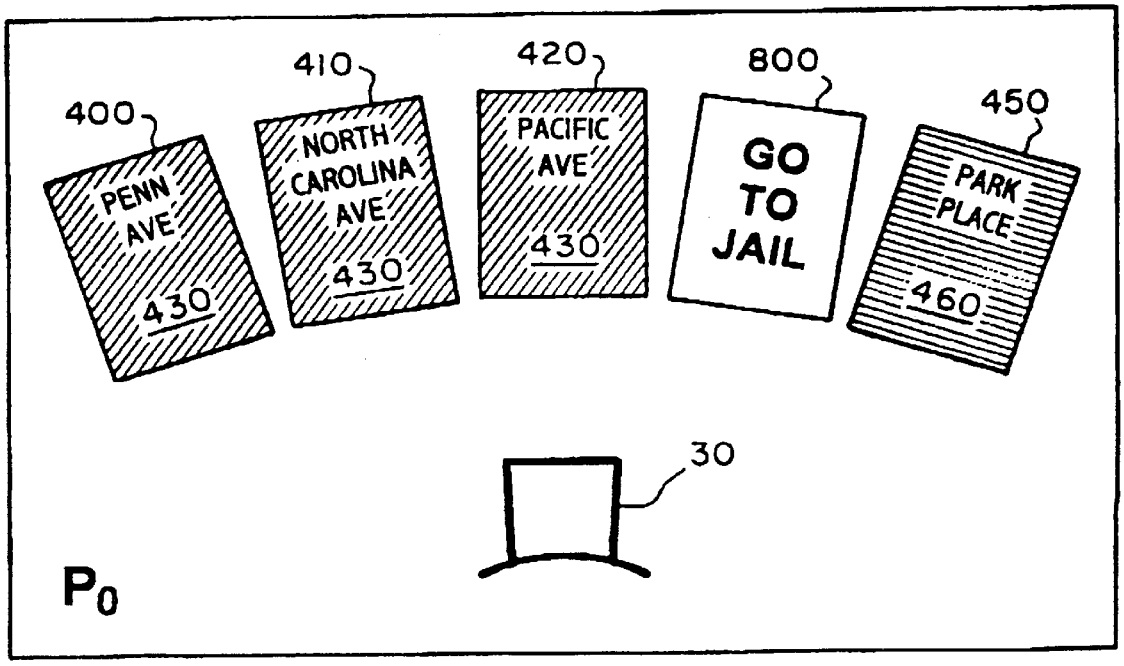
FIG. 8 represents a fifth hand of the card game of the present invention.

In Table III above, no subset of nullifying cards are used. Assume instead that the three "Go to Jail" cards are in the subset of nullifying cards. In FIG. 8, player $P_0$ receives the GO TO JAIL card 800 which results in immediate loss. Hence, player at position $P_0$ loses immediately even though the player has a monopoly based upon cards 400, 410, 420, all of the same color 430.

An alternate version of the card game of the present invention has slightly different card values (only 4 wild cards, everything else remains the same), and has the player make an additional 1-unit wager to stay in the hand. The options under this alternate version are thus 1) "mortgage" and surrender 1 unit; 2) "stay in" and wager 1 additional unit. Other ante/call wagering structures are equivalent and do not limit the teachings of the game.

A progressive side wager can also be provided. For example, a hand consisting of three Green and two Blue properties may win 100% of the progressive amount. For the forty-six card deck, the frequency of this hand is 1 in 1.37 million.

TABLE V

| Winning Progressive Combination | Pays |
|---|---|
| Blue + Green color groups (no Wild) | 100% |
| 2-card + 3-card color groups (no Wild) | 10% |
| 4 railroads | $2,500 |
| 3 railroads | $100 |
| Any 2 color groups | $25 |

Table V sets forth payoffs that include percentages and fixed payouts, assuming a wager of one dollar. Statistically, every wager by a player is broken down as follows:

1.8% for contribution to a $25,000 seed of given pool;

33% contribution towards a progressive meter; and

After paying the fixed payoffs, 15% of the wager goes to the house as profit (house advantage) for operation of the game. Based upon the above payoff table, the average progressive jackpot is approximately $250,000 when the blue plus green color groups are hit. This occurs approximately every 1,370,754 hands.

In a most preferred embodiment, assuming the deck composition of the second example given above, the following progressive pay schedule is adopted, base on a $1 wager.

| Hand Type | Pays |
|---|---|
| 2 Blue + 3 Green OR 5 Tax | 100% |
| 2 Blue + 3 RR OR 2 Blue + 3 Wild | 10% |
| 4 RR | 5% |
| 4 Wild | $250 |
| 3 RR | $50 |
| 3 Wild | $20 |

Note that these progressive qualifying hands, and associated payoffs, are exemplary and are not meant to limit the teachings of this invention.

4. Poker Variation

A like-kind casino card game of the present invention can be adopted to a standard poker deck having fifty-two cards.

Under one embodiment, the fifty-two cards can be allocated to both value cards 210 and to subset cards 280. For example, the value cards could be based upon the card rank of 2 through 10. The conventional ace cards could be player specific with one of the ace card symbols at each position 30. In this embodiment, the face cards of jack, queen, and king could be worthless. Hence, a player would win when a hand has a winning combination of like-kind value cards of, for example, four 4 s, four 8 s, four 10 s, etc. The presence of any face card, in this embodiment, would simply occupy space in a player's hand. However, if a player receives a player specific card of one of the aces (player specific by rank and suit), that specific card has special meaning which in this embodiment is a wild card. Hence, if a player has three 4 s, the presence of such a player specific card matching the symbol 30 causes four like-kind 4 s in a winning combination. Finally, should a player receive one of the two conventional joker cards, that too is a wild card and can be combined with any other value card to possibly form four like-kinds. In this embodiment, one could easily provide for more winning combinations by providing payoffs for three of a kind such as three 5 s. Under the teachings of the present invention, the allocation of conventional rank and suit into the value cards 210 and the subset cards 280 can comprise a large number of variants and combinations.

In another embodiment, assume four decks of cards based upon the distribution in the aforesaid embodiment. However, only one joker card is provided for all four decks. In this embodiment, the joker card could be assigned to be a "win" card 270 and when a player receives the joker card in their hand, they immediately win a prize such as a fixed amount or a progressive amount. In addition, and in variations thereto, the player could still treat the joker as a wild card and complete the game hand.

In another embodiment, the cards in a conventional poker deck could be classified as follows: jokers are wild, aces are player specific, the rank 2 through 10 are value cards, face cards are worthless except the Queen of Hearts which could be a contingent card. Should a player receive the Queen of Hearts and have a winning combination (such as four 5 s or, if the pay table allows it, three 5 s), the presence of the Queen of Hearts results in a ten times payoff. This, of course, adds considerable excitement to the play of the game.

The above disclosure sets forth a number of embodiments of the present invention. Those skilled in this art will however appreciate that other arrangements or embodiments, not precisely set forth, could be practiced under the teachings of the present invention.

The following summarizes some, but not all of the inventive features contained herein:

What is claimed is:

1. A casino card game comprising:

a deck of cards;

a hand of cards randomly dealt from said deck to at least one player, said hand having at least one card, and said deck of cards having:

(a) a plurality of value cards in said deck of cards, and (b) a subset of cards in said deck of cards containing player specific cards; when said player receives a player specific card in said hand which matches an identifier separately associated with said player, said player specific card assumes a special meaning in said players hand; when said identifier does not match said identifier separately associated with said player, said player specific card does not assume said special meaning;

said hand having value when at least one winning combination of value cards exists in said hand.

2. The casino card game of claim 1 wherein said plurality of value cards comprise groups of like-kind cards and said winning combination is one of said groups of like-kind cards.

3. The casino card game of claim 2 wherein each group of like-kind cards has a different color.

4. The casino card game of claim 1 wherein said player specific card that does not assume said special meaning assumes a different special meaning.

5. The casino card game of claim 1 wherein said special meaning comprises a wild card.

6. The casino card game of claim 1 wherein said special meaning comprises a can't lose hand.

7. The casino card game of claim 1 wherein said identifier comprises an extrinsic identifier.

8. The casino card game of claim 7 wherein said extrinsic identifier comprises a symbol near said player.

9. The casino card game of claim 1 wherein said identifier comprises an intrinsic identifier.

10. The casino card game of claim 1 wherein said identifier comprises a randomly selected identifier.

11. The casino card game of claim 1 wherein said hand wins when said at least one winning combination is found in a pay table.

12. The casino card game of claim 1 wherein said hand wins when said at least one winning combination is greater than the dealer's hand.

13. The casino card game of claim 1 wherein said hand wins when said at least one winning combination is greater than a player's hand.

14. The casino card game of claim 1 wherein a display shows the cards dealt.

15. The casino card game of claim 1 wherein a pay table is included for use in a like-kind game where a player has the option to draw and replace cards to complete a like-kind hand.

16. A casino card game comprising:

a deck of cards;

a hand of cards randomly dealt from said deck to at least one player, said hand having at least one card, and said deck of cards having:

(a) a plurality of value cards in said deck of cards, and (b) a subset of cards in said deck of cards containing worthless cards; when said player receives a worthless card in said player's hand, said worthless card assuming no value in said hand;

(c) a subset of cards in said deck of cards containing player specific cards; when said player receives a player specific card in said hand which matches an identifier separately associated with said player, said player specific card assumes a special meaning in said player's hand; when said identifier does not match said identifier separately associated with said player, said player specific card does not assume said special meaning; said hand having value when at least one winning combination of value cards exists in said hand.

17. The casino card game of claim 16 wherein a display shows the cards dealt.

18. The casino card game of claim 16 wherein a pay table is included for use in a like-kind game where a player has the option to draw and replace cards to complete a like-kind hand.

19. A casino card game comprising:

a deck of cards;

a hand of cards randomly dealt from said deck to at least one player, said hand having at least one card, and said deck of cards having:

(a) a plurality of value cards in said deck of cards, and (b) a subset of cards in said deck of cards containing contingent cards, said contingent card having a significance contingent upon what other cards are present in the player's hand;

said hand having value when at least one winning combination of value cards exists in said hand.

20. The casino card game of claim 19 wherein a display shows the cards dealt.

21. The casino card game of claim 19 wherein a pay table is included for use in a like-kind game where a player has the option to draw and replace cards to complete a like-kind hand.

22. The casino card game of claim 19 wherein said contingent card yields additional payoff value when used with a winning combination of said value cards.

23. A casino card game comprising:

a deck of cards;

a hand of cards randomly received from said deck, said hand having at least one card, and said deck of cards having:

(a) a plurality of value cards in said deck of cards, (b) a subset of cards in said deck of cards containing player specific cards; when said player receives a player specific card in said hand which matches a symbol separately associated with said player, said player specific card assumes a special meaning in said player's hand; when said symbol does not match said symbol separately associated with said player, said player specific card does not assume said special meaning, (c) another subset of cards in said deck of cards containing worthless cards; when said player receives a worthless card in said player's hand, said worthless card assuming no value in said hand, (d) another subset of cards in said deck of cards containing contingent cards, said contingent card having a significance contingent upon what other cards are present in the player's hand;

said hand having at least one winning combination when a number of received cards of the same value exist in said hand.

24. A casino card game comprising:

a deck of cards;

a hand of cards randomly dealt from said deck to at least one player, said hand having at least one card, and said deck of cards having:

(a) a plurality of value cards in said deck of cards, and (b) a subset of cards in said deck of cards containing worthless cards; when said player receives a worthless card in said player's hand, said worthless card assuming no value in said hand;

(c) a subset of cards in said deck of cards containing contingent cards, said contingent card having a significance contingent upon what other cards are present in the player's hand;

said hand having value when at least one winning combination of value cards exists in said hand.

25. The casino card game of claim 24 wherein a display shows the cards dealt.

26. The casino card game of claim 24 wherein a pay table is included for use in a like-kind game where a player has the option to draw and replace cards to complete a like-kind hand.

* * * * *